US010314375B2

(12) United States Patent
Ciraolo

(10) Patent No.: US 10,314,375 B2
(45) Date of Patent: Jun. 11, 2019

(54) STORAGE BAG CONVERTIBLE INTO A TRAVEL SEAT

(71) Applicant: Simone Antonino Ciraolo, Porto Sant'elpidio (IT)

(72) Inventor: Simone Antonino Ciraolo, Porto Sant'elpidio (IT)

( * ) Notice: Subject to any disclaimer, the term of this patent is extended or adjusted under 35 U.S.C. 154(b) by 91 days.

(21) Appl. No.: 15/116,141

(22) PCT Filed: Mar. 5, 2015

(86) PCT No.: PCT/IB2015/051603

§ 371 (c)(1),
(2) Date: Aug. 2, 2016

(87) PCT Pub. No.: WO2015/132746

PCT Pub. Date: Sep. 11, 2015

(65) Prior Publication Data

US 2017/0143084 A1 May 25, 2017

(30) Foreign Application Priority Data

Mar. 7, 2014 (IT) ..... RM2014A0109

(51) Int. Cl.
*A45C 9/00* (2006.01)
*A45F 4/02* (2006.01)
(Continued)

(52) U.S. Cl.
CPC ..... *A45C 9/00* (2013.01); *A45C 13/262* (2013.01); *A45F 4/02* (2013.01); *A47D 1/10* (2013.01);
(Continued)

(58) Field of Classification Search
CPC ..... A45C 9/00; A45C 13/262; A45C 5/14; A45C 2009/002; A47C 4/52; A47C 1/146
(Continued)

(56) References Cited

U.S. PATENT DOCUMENTS 5,062,557 A * 11/1991 Mahvi ..... A45C 7/0086 190/108
5,620,227 A * 4/1997 Brune ..... A41D 15/04 224/155
(Continued)

FOREIGN PATENT DOCUMENTS

EP 0 422 759 4/1991
EP 1 402 797 3/2004
(Continued)

OTHER PUBLICATIONS

International Search Report dated Jun. 25, 2015 issued in PCT International Application No. PCT/IB2015/051603, 3 pp.

*Primary Examiner* — Fenn C Mathew
*Assistant Examiner* — Cynthia F Collado
(74) *Attorney, Agent, or Firm* — Nixon & Vanderhye P.C.

(57) ABSTRACT

A storage bag is convertible into a travel seat when the bag assumes an open configuration. The bag includes a front part and a lid attachable to two side parts of the bag when the bag assumes a closed configuration. The front part and lid can be decoupled and separated from the two side parts when the bag assumes the open configuration. The bag includes a rigid structure provided with safety belts and padding. The includes a pass-through pocket integrally coupled to a rear part of the bag and a handle arranged on the lid that are configured to receive and to be crossed by an extensible handle of a suitcase to removably couple the bag to the suitcase.

16 Claims, 8 Drawing Sheets

(51) Int. Cl.
*A47D 1/10* (2006.01)
*A47D 11/00* (2006.01)
*A45C 13/26* (2006.01)

(52) U.S. Cl.
CPC ..... *A47D 11/00* (2013.01); *A45C 2009/002* (2013.01); *A45C 2013/267* (2013.01); *A45F 2004/026* (2013.01)

(58) Field of Classification Search
USPC ..... 297/255; 190/8; 280/47.26, 47.38
See application file for complete search history.

(56) References Cited

U.S. PATENT DOCUMENTS 5,819,999 A * 10/1998 Tennant ..... A45F 4/02 224/155
6,241,313 B1 6/2001 Lenz et al.
2002/0167214 A1* 11/2002 Nelson ..... A47D 1/103 297/485
2003/0038008 A1* 2/2003 Han ..... A45C 3/00 190/115
2004/0021353 A1* 2/2004 Lozano ..... A45C 13/00 297/255
2008/0036256 A1* 2/2008 Gold ..... A47D 1/02 297/255
2009/0289480 A1* 11/2009 McFarland ..... A45C 13/262 297/255
2018/0146757 A1* 5/2018 Singh Johar ..... A45C 13/262

FOREIGN PATENT DOCUMENTS

FR 2 863 466 6/2005
GB 2 422 300 7/2006
GB 2 430 612 4/2007
WO WO 2004/100699 11/2004

* cited by examiner

STORAGE BAG CONVERTIBLE INTO A TRAVEL SEAT

This application is the U.S. national phase of International Application No. PCT/IB2015/051603 filed Mar. 5, 2015 which designated the U.S. and claims priority to Italian Patent Application No. RM2014A000109 filed Mar. 7, 2014, the entire contents of each of which are hereby incorporated by reference.

The present invention concerns a storage bag convertible into a travel seat configured to be coupled to a suitcase, advantageously of small or medium size, provided with an extensible handle, advantageously provided with wheels, that permits the transport of an infant in a safe, comfortable and handy way, the bag being capable to be made in an inexpensive way.

Although in the following reference will be mainly made to the use of the bag convertible in travel seat in the context of an airplane boarding, it must be understood that the bag convertible in seat according to the invention is usable in all those contexts where it is necessary to move, optionally through any means of transport, with a luggage and a young child without the additional encumbrance of a stroller, still remaining within the scope of protection as defined in the attached claims.

Travelling with very young children, who are not capable to walk or who are not capable to walk for long distances and/or prolonged time periods, may be very difficult and tiring, especially in crowded environments such as ports, airports, and train stations. In these places it is necessary to carry luggage, to have easily available personal and travel documents possibly separated from the luggage, usually contained in a smaller handbag, having hands free to carry out all the operations necessary for boarding, as well as to keep under control the child in these crowded places, even briefly turning the attention away from the same child so as to be able to accomplish the boarding operations. Often, it is decided (or it is necessary) to renounce the stroller for reducing the number of luggage to carry, also motivated by the new trend of renting equipment for children in the place of arrival.

Several solutions have been proposed in the prior art for solving this problem.

Documents WO 2004/100699 A1, GB 2430612 A, EP 1402797 A1 propose suitcases provided with wheels which include a seat for transporting a child. However, such solutions have a child's seat formed by a seat and a backrest without side protections and, consequently, they do not permit a safe and comfortable transport of even very young children. Moreover, such seats are made to be closed again and incorporated in the same suitcases, for instance being retractable and/or foldable. This causes an increase of the number of mechanical elements of the seats and/or suitcases which, besides increasing the cost of the suitcase, are subject to malfunctioning and ruptures, especially during boarding and landing operations. Also, such prior art solutions increase the weight and specific volume of the suitcase decreasing the space that may be occupied by personal items and their weight. Hence such solutions are inefficient and not inexpensive.

Other solutions have been proposed in the prior art which have seat systems to be attached to the suitcases. By way of example, the patent U.S. Pat. No. 6,241,313 B1 and the application FR 2863466 have chair structures to attach to a suitcase provided with wheels. However, these solutions introduce a further bulky luggage to board instead of decreasing the number of luggage and increasing the ease of transport, as well as the aforementioned problems of costs related to the luggage weight. Moreover, although the chair structures are external and accessory to the suitcase, the suitcase must be specific to attach such structures.

It is an object of this invention to overcome the disadvantages described hitherto, allowing in a safe, comfortable, handy and inexpensive way the transport of an infant.

It is specific subject-matter of the present invention a storage bag convertible into a travel seat when the bag assumes an open configuration, the bag being configured to be carried by hand by means of a handle, and being further configured to be removably coupled to a suitcase provided with an extensible handle, the bag being characterised in that it comprises a front part and a lid configured to be coupled to two side parts of the bag through first removable coupling mechanical means when the bag assumes a closed configuration, and to be decoupled and separated from the two side parts when the bag assumes the open configuration, the handle being arranged on the lid, the bag comprising a rigid structure, placed within the bag, provided with safety belts configured to be fastened in front of a torso of a child sitting in the bag when the latter assumes the open configuration, and a padding superimposed on the rigid structure, the bag being provided with a pass-through pocket integrally coupled to a rear part of the bag, the pass-through pocket and the handle being configured to receive and to be crossed by an extensible handle of a suitcase.

According to another aspect of the invention, the rigid structure may comprise a main part coupled to an upper part, the main part comprising a backrest and a seat, the main part being configured to support the body and at least partially the legs of a child when the bag assumes the open configuration, the upper part being configured to support the head of a child when the bag assumes the open configuration.

According to a further aspect of the invention, the rigid structure may further comprise two side wings configured to confine the backrest and at least partially the seat when the bag assumes the open configuration.

According to an additional aspect of the invention, said first removable coupling mechanical means may comprise zippers and/or mechanical and/or magnetic buttons and/or Austrian knots and/or hooks.

According to another aspect of the invention, the rigid structure may be removably coupled to the storage bag through second coupling mechanical means, optionally comprising nickel and brass screws having a male/female arrangement and/or hook and loop fabric mechanical devices and/or screws, the rigid structure being configured to be extracted from the bag.

According to a further aspect of the invention, the handle and the pocket may have the same width, the handle and the pocket being optionally of the same material.

According to an additional aspect of the invention, the bag may be provided on a base with a plurality of feet, optionally four feet.

According to another aspect of the invention, the rigid structure may be made of thermoformed plastic, optionally of polycarbonate.

According to a further aspect of the invention, the padding may be made of hypoallergenic and/or breathable and/or fire-proof material.

According to an additional aspect of the invention, the bag may be provided with a plate, optionally a metal plate, more optionally applied on the lid.

The present invention is based on a storage bag convertible into a travel seat configured to be coupled to a suitcase, advantageously of small or medium size, provided with extensible handle, advantageously provided with wheels, that permits the transport of an infant, for instance a child aged from 4 to 14 months, in a safe and comfortable manner, without increasing the number of luggage to board, the bag being capable to be manufactured in an inexpensive manner.

The present invention permits to obtain the following main advantages with respect to the solutions present in the prior art.

The first advantage is that it may be coupled to a wide variety of suitcases having standard size and configuration currently on the market, provided with extensible handle and advantageously with wheels, with no need of buying a specific suitcase that is more expensive and/or with a larger number of mechanical elements which can break during boarding and landing operations.

The second advantage is that, since it may be coupled to suitcases having standard size and configuration, the convertible storage bag does not affect the weight and dimensions of the same suitcase, hence the number and weight of the items which can be transported remain unchanged.

A further advantage is that the convertible storage bag according to the invention may be used as a simple bag for containing the personal items when it is not used as child's seat, such as for instance when there is no more need to use the child's seat in view of the growth of the child, the cost-benefit ratio of the same convertible storage bag being consequently low.

The present invention will be now described, by way of illustration and not by way of limitation, according to one of its preferred embodiments, by particularly referring to the Figures of the annexed drawings, in which:

FIG. 1 schematically shows a possible sequence of use of a preferred embodiment of the storage bag convertible into a travel seat according to the invention, that includes an extractable bag;

Figure 1:
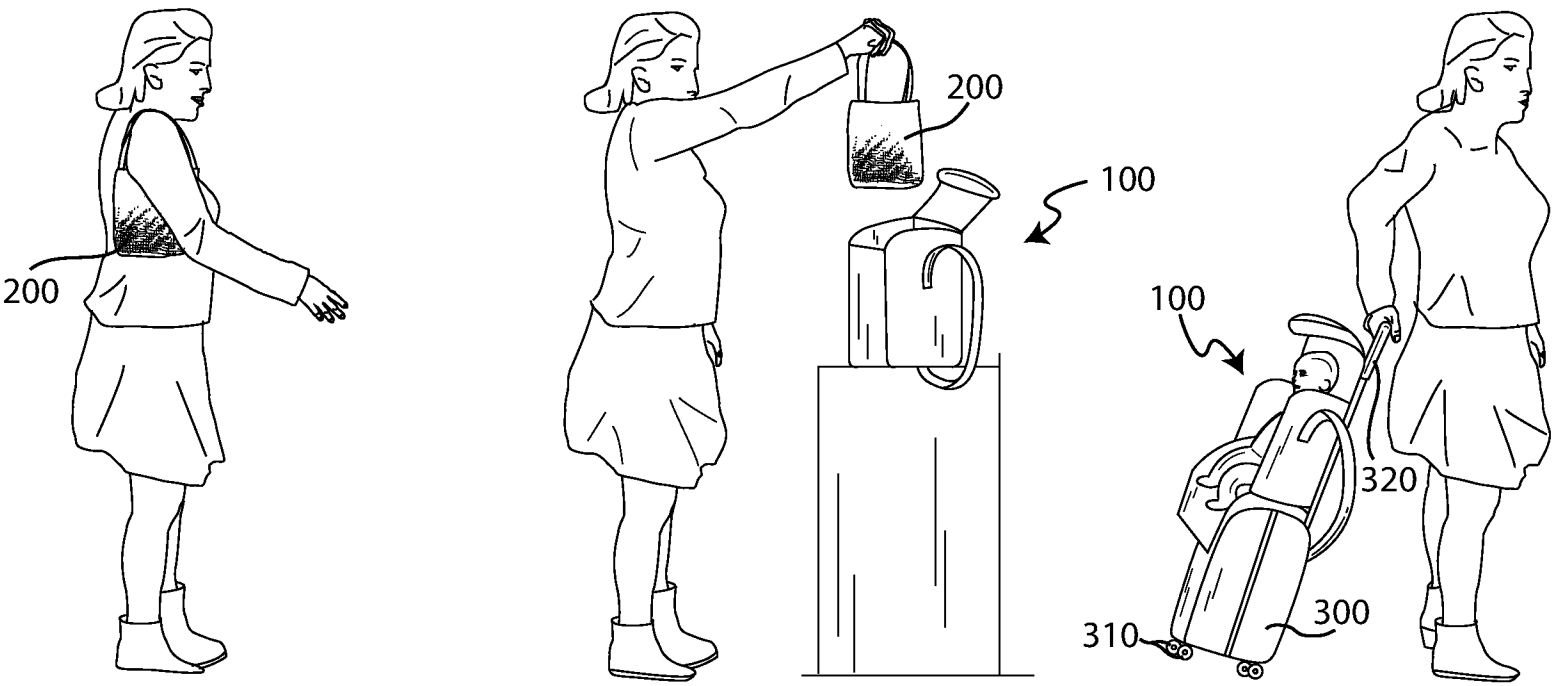

In FIG. 1 a possible sequence of use of a preferred embodiment of the storage bag 100 convertible into a travel seat according to the invention is shown. The bag 100 is optionally made of leather and/or strong and/or impermeable tissue (even if the material of the bag is not an essential feature of the invention), and it optionally contains a bag 200 of non-rigid material, such as tissue and/or leather and/or impermeable material, in which it is possible to put personal items and that is possible to extract from the storage bag 100 convertible into a travel seat when the bag 100 is applied to a suitcase 300 provided with extensible handle 320, and advantageously with wheels 310, so as to be used in open configuration as child's chair thanks to the zippers 111 and 112 shown in FIGS. 2 and 3 which open and close the front part 105 and the lid 110 of the bag 100 with respect to the side parts 106 of the latter. In other embodiments of the present invention, the zippers 111 on the lid may be replaced with other closing/opening means, such as mechanical and/or magnetic buttons, Austrian knots, hooks. The size of the storage bag 100 convertible into a travel seat, though this is not an essential feature of the present invention, may vary, but it must be such that it maintain stability when the bag 100 is coupled to the suitcase and used as child's chair; consequently, the size of the bag 100 is advantageously comparable with the size of a suitcase provided with wheels and standard extensible handle to which it couples. In particular, the storage bag 100 convertible into a child's chair has a width optionally lower than 49 cm, still more optionally equal to 29 cm, a depth optionally not larger than 30 cm, still more optionally equal to 20 cm, and a height optionally not larger than 40 cm, still more optionally equal to 32 cm.

Figure 2:
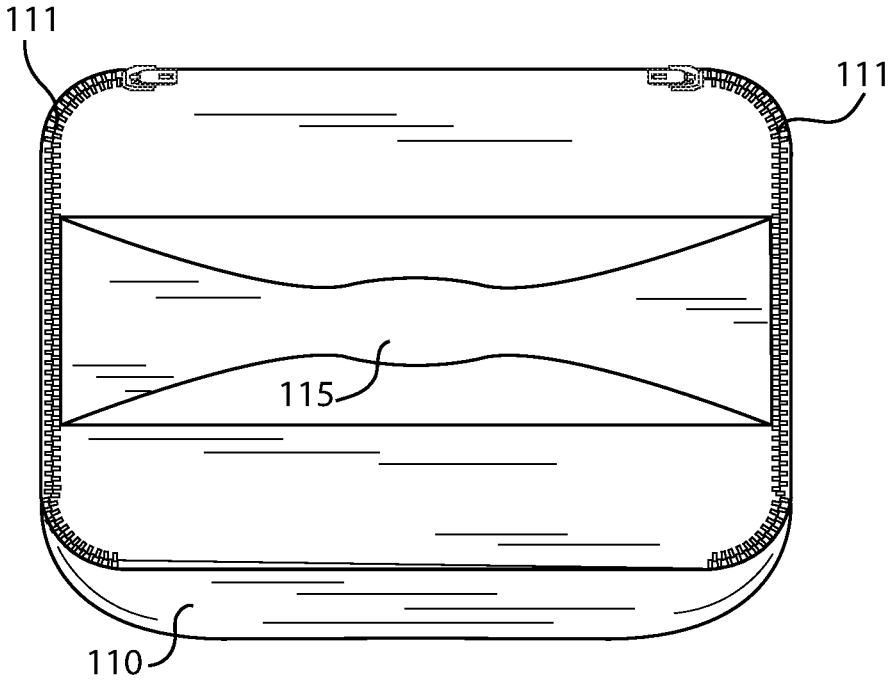
FIG. 2 is a schematic top plan view of the storage bag convertible into a travel seat of FIG. 1, that shows the lid.
Figure 3:
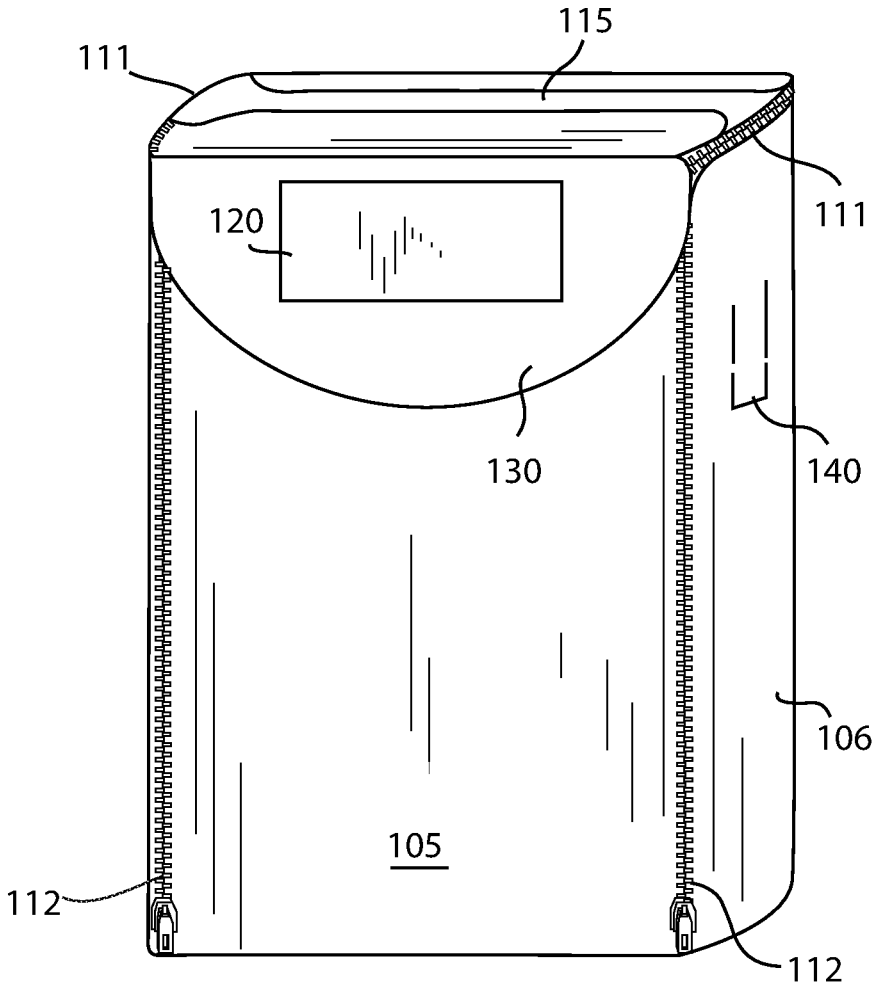
FIG. 3 is a schematic front perspective view of the storage bag convertible into a travel seat of FIG. 1, that shows the front aperture.
Figure 4:
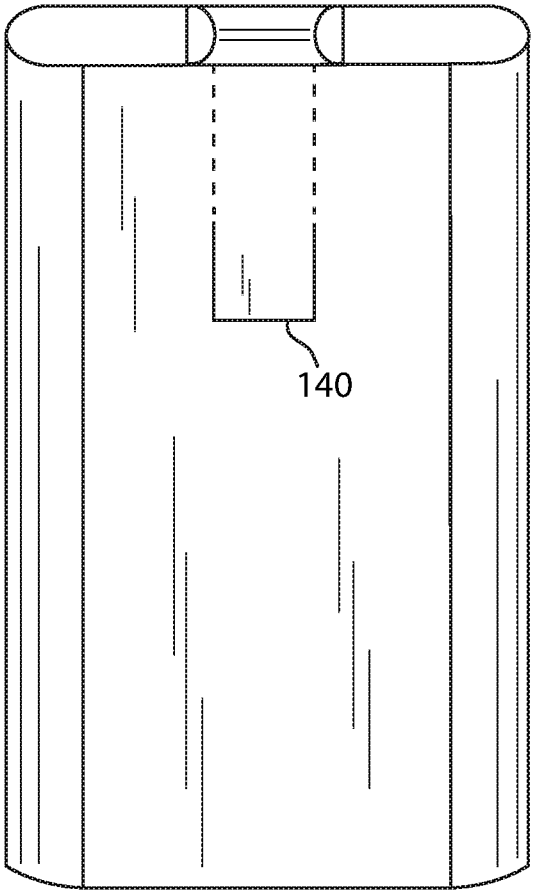
FIG. 4 is a schematic side perspective view of the storage bag convertible into a travel seat of FIG. 1, that shows the attachment of the shoulder strap.

FIG. 2 shows the lid 110 that may be opened thanks to the side zippers 111 of the preferred embodiment of the storage bag 100 convertible into a travel seat according to the invention of FIG. 1. A handle 115, optionally of the same material of which the bag 100 is made, is attached in a non-removable way onto the lid. The lid 110 has a front flap 130 shown in FIG. 3. Other embodiments may have the front flap 130 that may close with suitable closing means, such as mechanical and/or magnetic buttons, Austrian knots, hooks, or they may be devoid of a flap. A plate 120, optionally of steel and of size 7×14 cm, may be applied onto the lid and it may include a trademark and/or identification data of the owner of the bag 100 or of the child; such plate is advantageously positioned so as to never get in contact with the child when he/she is seated within the bag 100 (when the latter is in open configuration), for instance it may be placed on the front flap 130 of the lid shown in FIG. 3. The plate is not an essential feature of the invention, whereby further embodiments of the bag according to the invention may be devoid of it or may have one or more labels positioned in locations different from the front flap 130. A shoulder strap of suitable shape and material may be applied laterally to the bag 100 for transporting the bag 100 when the child is not seated inside the same; in particular, the attachment 140 of the shoulder strap is visible in FIGS. 3 and 4. Other embodiments may have handgrips along with or in place of the shoulder strap.

Figure 5:
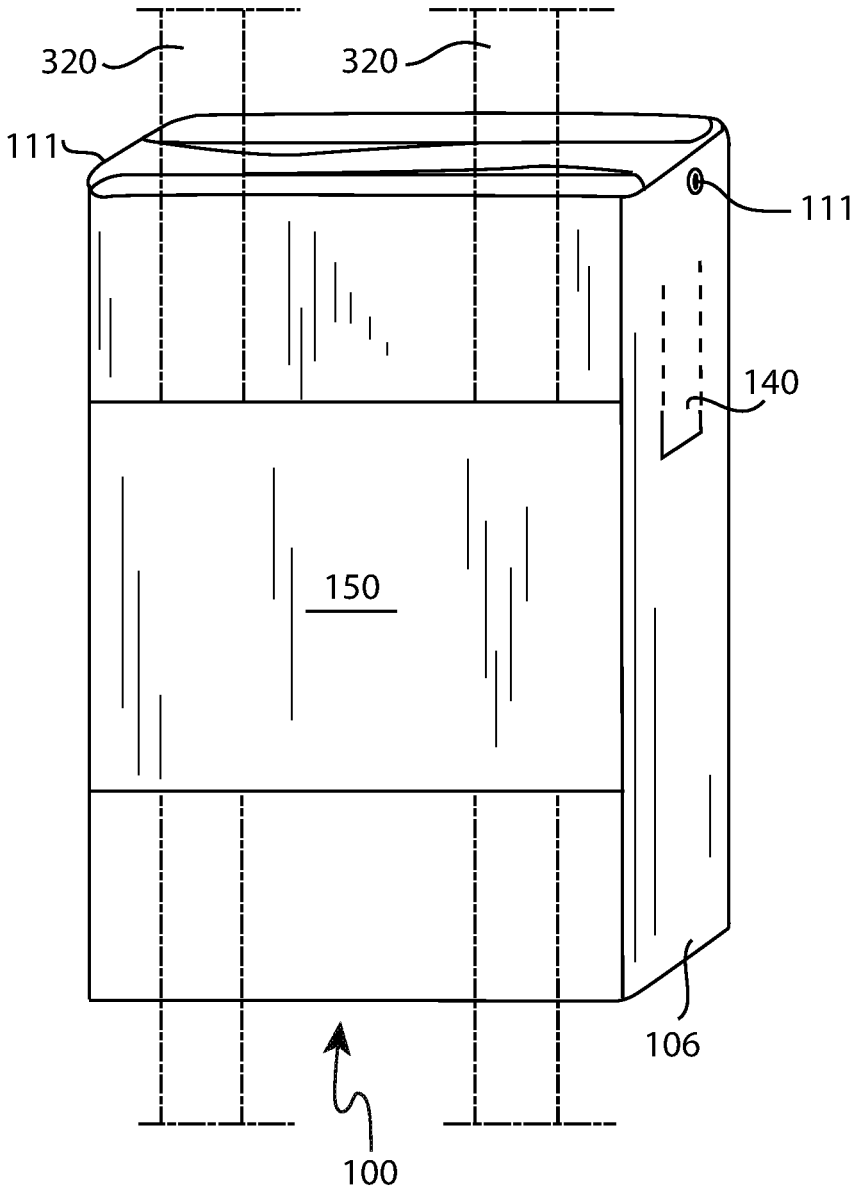
FIG. 5 is a schematic rear perspective view of the storage bag convertible into a travel seat of FIG. 1, that shows the attachment for the insertion of the extensible handle of a suitcase.
Figure 6:
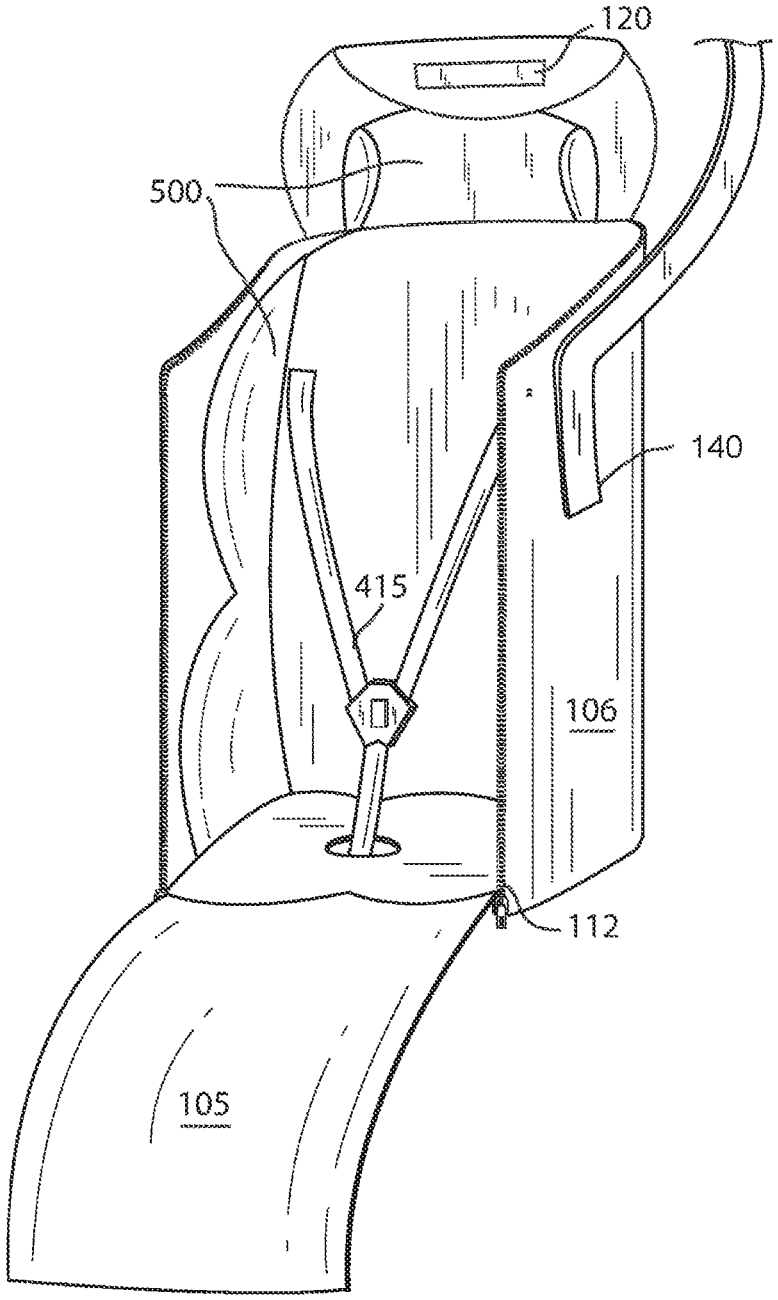
FIG. 6 is a schematic perspective view of the storage bag convertible into a travel seat of FIG. 1 in an open configuration.
Figure 7:
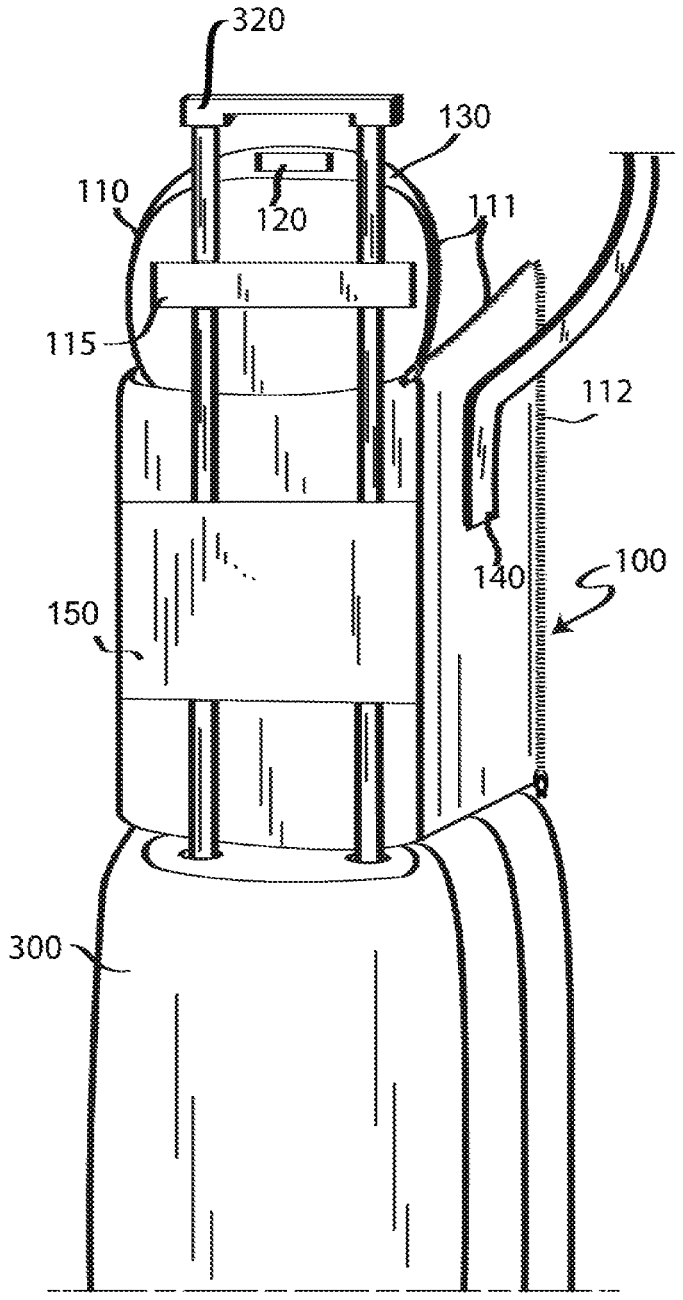
FIG. 7 is a schematic rear perspective view of the storage bag convertible into a travel seat of FIG. 1 in the open configuration and coupled to a suitcase provided with wheels and extensible handle.

With reference to FIGS. 6 and 7, the bag 100 in the open configuration transforms into a child's chair and is configured to be anchored to the extensible handle 320 of a suitcase (advantageously a trolley case provided with wheels) through the handle 115 and a pass-through pocket 150 integrally coupled to the rear part of the bag 100 (as shown in FIGS. 5 and 7), optionally made of the same material of the handle 115 and/or of the bag 100. As shown in FIG. 7, the handle 115 and the pass-through pocket 150 in the rear part optionally have equal dimensions in width and strength characteristics, so as to anchor in the same way the bag 100 in the open configuration, i.e. the child's chair into which the bag 100 has been transformed, to the suitcase 300 and to give stability to the child's chair during its use.

Advantageously, the handle 115 has width sufficient to guarantee an extended interaction with the rod of the extensible handle 320 in order to ensure stability to the child's chair, and to avoid that instinctively it is grasped for transporting the storage bag 100 convertible into a travel seat; in any case, the dimensions in width of the handle 115 are not an essential feature of the storage bag 100 convertible into a travel seat according to the invention. Optionally, the handle 115 has the same width of the lid, i.e. of the same storage bag 100 convertible into a travel seat, and a height in the zones of attachment to the lid equal to 8 cm. Also the pocket 150 optionally has the same width of the bag 100; the height of the pocket 150 is optionally equal to 15 cm.

Figure 8:
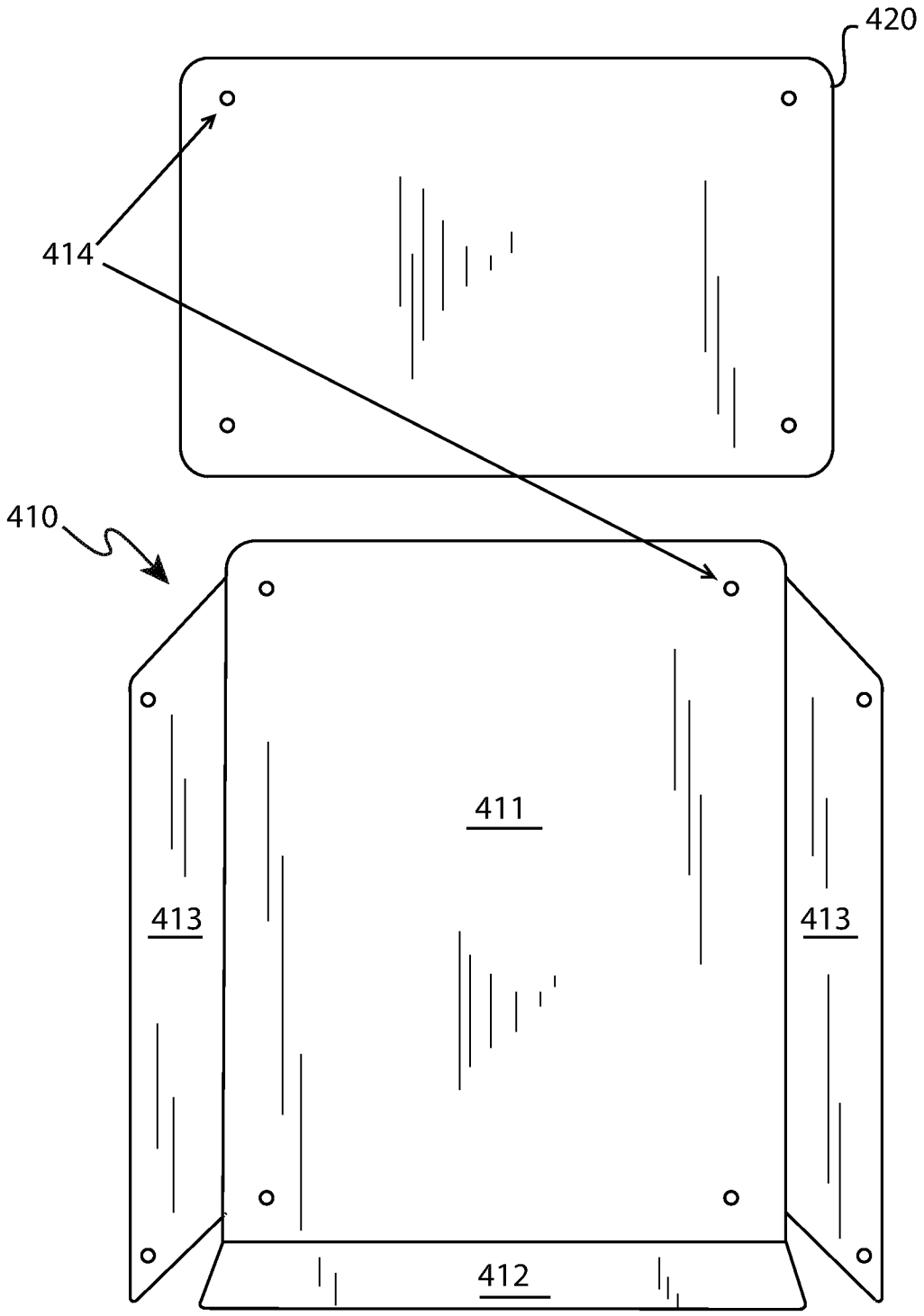
FIG. 8 is a schematic perspective view of a particular of the storage bag convertible into a travel seat of FIG. 1.

A rigid structure of thermoformed plastic, such as for instance polycarbonate, placed within the storage bag 100 convertible into a travel seat of the preferred embodiment of the invention and configured to house a child during transport, is shown in FIG. 8. The rigid structure includes two parts: a main part 410 configured to support the body and at least partially the legs of the child, and an upper part 420 configured to support the head of the child. The two parts 410 and 420 are joined with suitable coupling means, such as strong tissue and/or a tissue hinge, and by the padding 500 coated with fabric shown in FIG. 6.

The main internal part 410 includes a backrest 411, a seat 412 and two side wings 413 configured to confine the backrest 411 and at least partially the seat 412 when the bag 100 assumes the open configuration, whereby the side wings 413 permit to use the child's chair even for transporting very young children, aged from 4 to 14 months, who have not yet a good control of motion and a good motor coordination. Other embodiments may have no side wings, or have them removable so as to eliminate them when the child grows up acquiring better control of motion and motor coordination. A suitable number of holes 414 are present in the rigid structure for attaching in a removable manner the rigid structure to the storage bag 100 through suitable coupling means, such as nickel and brass screws having a male/female arrangement. In this way it is possible to extract the rigid structure from the bag 100 for rendering the same more lightweight and handy once that its function of child's chair is terminated. Other embodiments may have different systems for removably coupling the rigid structure to the bag 100, such as for instance hook and loop fabric mechanical devices (also known with the commercial name Velcro®), remaining within the scope of the present invention. The seat 412 is optionally attached to the lower part of the bag through screws inserted into respective holes (not shown in the Figures) to which four feet (also not shown in the Figure) are advantageously attached at the base of the bag 100 which serve as support on the suitcase and for resting the bag 100 on the floor when it is not used as child's chair.

The size of the rigid structure of FIG. 8 may vary according to the size of the bag 100 to which it must be attached. In the preferred embodiment of FIG. 8 the size are as follows:

upper part 420: 27.5 cm of width×18 cm of height;
backrest 411: 24 cm of width×30.5 cm of height;
seat 412: 24 cm of width×19 cm of depth;
each side wing 413: 16 cm of width×27 cm of height.

However, the size of the rigid structure of FIG. 8 is not an essential feature of the present invention.

As shown in FIG. 6, the rigid structure is provided with safety belts 415 (not shown in FIG. 8) configured to be fastened in front of a torso of the child seated on the bag 100 in open configuration. Optionally, the belts are configured so that, when fastened, the child is blocked at the waist and at the shoulders. The storage bag 100 convertible into a travel seat includes an ergonomic padding 500 of hypoallergenic, breathable and fire-proof material, configured to wrap even laterally the child seated on the bag 100 in open configuration ensuring comfort to the child (see FIG. 6). Further embodiments of the storage bag convertible into a travel seat according to the invention may have shapes of the padding different from that shown in the Figures for the preferred embodiment.

The preferred embodiments of this invention have been described and a number of variations have been suggested hereinbefore, but it should be understood that those skilled in the art can make other variations and changes without so departing from the scope of protection thereof, as defined by the attached claims.

The invention claimed is:

1. Storage bag convertible into a travel seat when the bag assumes an open configuration, the bag comprising a handle and being configured to be removably coupled to a suitcase provided with an extensible handle, the bag further comprising a front part and a lid removably connectable to two side parts of the bag through a first removable coupling when the bag assumes a closed configuration, the front part and the lid being decoupled and separated from the two side parts when the bag assumes the open configuration while remaining coupled with the bag, the handle being arranged on the lid, the bag further comprising a rigid structure, placed within the bag, provided with safety belts configured to be fastened in front of a torso of a child sitting in the bag when the bag assumes the open configuration, and a padding superimposed on the rigid structure, the bag further comprising a pass-through pocket integrally coupled to a rear part of the bag, wherein in the open configuration, the pass-through pocket and the handle are aligned to receive and to be crossed by the extensible handle of the suitcase, and wherein the pass-through pocket and the handle are configured to cooperatively anchor the bag in the open configuration to the extensible handle.

2. Bag according to claim 1, wherein the rigid structure comprises a main part coupled to an upper part, the main part comprising a backrest and a seat, the main part being configured to support the body and at least partially the legs of a child when the bag assumes the open configuration, the upper part being configured to support the head of a child when the bag assumes the open configuration.

3. Bag according to claim 2, wherein the main part of the rigid structure further comprises two side wings configured to confine the backrest and at least partially the seat when the bag assumes the open configuration.

4. Bag according to claim 1, wherein said first removable coupling comprises zippers and/or mechanical and/or magnetic buttons and/or Austrian knots and/or hooks.

5. Bag according to claim 1, wherein the rigid structure is removably coupled to the storage bag through a second coupling, the rigid structure being configured to be extracted from the bag.

6. Bag according to claim 1, wherein the handle and the pass-through pocket have the same width.

7. Bag according to claim 1, wherein it is provided on a base with a plurality of feet.

8. Bag according to claim 1, wherein the rigid structure is made of thermoformed plastic.

9. Bag according to claim 1, wherein the padding is made of hypoallergenic and/or breathable and/or fire-proof material.

10. Bag according to claim 1, further comprising a plate on the lid.

11. Bag according to claim 5, wherein the second coupling comprises nickel and brass screws having a male/female arrangement and/or hook and loop fabric mechanical devices and/or screws.

12. Bag according to claim 1, wherein the handle and the pass-through pocket are made of the same material.

13. Bag according to claim 7, wherein the base comprises four feet.

14. Bag according to claim 1, wherein the rigid structure is made of polycarbonate.

15. Bag according to claim 10, wherein the plate is a metal plate.

16. Storage bag convertible into a travel seat when the bag assumes an open configuration, the storage bag comprising:

a main body including a front part, a rear part, side parts, a bottom and a lid;

a handle coupled with the lid;

a pass-through pocket coupled with the rear part, wherein the lid is parallel with the rear part in the open configuration such that the handle and the pass-through pocket are aligned in the open configuration; and a rigid structure disposed within the main body and including safety belts and a padding, wherein the front part of the main body is removably coupled with the side parts while remaining coupled with the bottom, wherein the lid is removably coupled with the side parts while remaining coupled with the rear part, and wherein the pass-through pocket and the handle are configured to cooperatively anchor the bag in the open configuration to an extensible handle of a suitcase.

* * * * *